US011746528B1

(12) United States Patent
Owens et al.

(10) Patent No.: US 11,746,528 B1
(45) Date of Patent: Sep. 5, 2023

(54) SKYLIGHT PROTECTIVE COVER

(71) Applicants: Ross Owens, Navan (CA); Claudia Owens, Navan (CA)

(72) Inventors: Ross Owens, Navan (CA); Claudia Owens, Navan (CA)

( * ) Notice: Subject to any disclaimer, the term of this patent is extended or adjusted under 35 U.S.C. 154(b) by 0 days.

(21) Appl. No.: 17/524,189

(22) Filed: Nov. 11, 2021

(51) Int. Cl.
*E04D 13/03* (2006.01)

(52) U.S. Cl.
CPC ..... *E04D 13/0315* (2013.01); *E04D 13/0335* (2013.01)

(58) Field of Classification Search
CPC ... E04D 13/0315; E04D 13/0335; E06B 1/34; E06B 3/30
See application file for complete search history.

(56) References Cited

U.S. PATENT DOCUMENTS

| | | | | |
|---|---|---|---|---|
| 4,117,638 | A | 10/1978 | Kidd, Jr. et al. | |
| 4,468,899 | A * | 9/1984 | Miller | E04D 13/031 52/204.593 |
| 5,216,855 | A * | 6/1993 | Richter | E06B 3/5821 52/204.593 |
| 5,323,576 | A | 6/1994 | Gumpert et al. | |
| 5,675,940 | A | 10/1997 | Bahar et al. | |
| 6,009,929 | A | 1/2000 | Linderman et al. | |
| 7,721,493 | B2 | 5/2010 | Skov et al. | |
| 7,937,900 | B1 | 5/2011 | Gaffney et al. | |
| 9,212,489 | B1 | 12/2015 | Erickson | |
| 9,677,279 | B2 | 6/2017 | Pendley et al. | |
| 10,072,421 | B2 | 9/2018 | Griffin et al. | |
| 2010/0269426 | A1 * | 10/2010 | Richter | E06B 3/28 52/204.593 |

* cited by examiner

*Primary Examiner* — Andrew J Triggs
(74) *Attorney, Agent, or Firm* — CRAMER PATENT & DESIGN, PLLC; Aaron R. Cramer

(57) ABSTRACT

A skylight protective cover is a weather resistant shroud having flashing about a peripheral edge configured to secure about an existing skylight in a manner which provides a space between the shroud and skylight thereby protecting the skylight from the elements.

9 Claims, 5 Drawing Sheets

SKYLIGHT PROTECTIVE COVER

RELATED APPLICATIONS

None.

FIELD OF THE INVENTION

The present invention relates to a protective cover and more specifically to a protective cover for a skylight.

BACKGROUND OF THE INVENTION

A skylight in a room provides a unique and functional architectural element. Not only does it make a room seem brighter and bigger, but it can let in light where ordinary windows cannot or will not work. When a person enters a room with a skylight for the first time, they cannot help but to be drawn to look out the skylight, even though nothing but the sky can be seen.

However, just about all skylights will suffer from leaks at one time during their life. Whether the leak is due to bad flashing, worn seals, or even crack panes of glass, repair of such damage is time consuming and expensive. Many times, repairs cannot be made quickly, and the leaks can cause damage to ceilings, walls and even structural members of the building. Accordingly, there exists a need for a means by which leaks from any and all areas of skylights can be stopped on either a temporary or permanent basis. The development of the skylight protective cover fulfills this need.

SUMMARY OF THE INVENTION

The inventor has recognized the aforementioned inherent problems and lack in the art and observed that there is a need for a skylight protective cover which has a plurality of peripheral frames making a border, a vision surface which is disposed on top of the skylight protective cover made of a smooth transparent material allowing for transmission a plurality of undistorted incoming light rays, an upper and perimeter mounting flashing which has a plurality of mounting holes, a plurality of exterior sheathing which is installed on a top side of the structural members while a plurality of interior surfaces which are installed on the interior side, a conventional skylight flashing which is installed as part of the skylight integrates with the roof surface and is disposed on a bottom of the skylight, a fastener routed through the mounting holes and into the exterior sheathing and/or structural members to hold the skylight protective cover in place and a holding channel which is the vision surface on the peripheral frame and is secured with a sealing method. The upper and perimeter mounting flashing which is disposed on the peripheral frames.

Each peripheral frames may be made from of a material selected from the group consisting of metal, plastic, wood, or composite material. Each peripheral frames may include a distance from the skylight on all sides. The smooth transparent material may be made of glass. The smooth transparent material may be made of plastic. The peripheral frames and the vision surface may be one continuous section of blow molded, injection molded, vacuum formed or another manner of molded plastic. The vision surface may include a smooth upper surface that allows the debris to slide off the vision surface onto the roof surface without melting.

The smooth upper surface may prevent the subsequent freezing of water and accumulation of ice on the roof surface that would infiltrate into the structure. The peripheral frame and the upper flashing and perimeter mounting may form a water barrier area. While not part of the skylight protective cover, the exterior sheathing upon which it may be installed may be made of plywood or orientated strand board while the interior surfaces may be made of drywall or paneling. The fastener may be a nail or screw or the like. The sealing method may be caulk or a rubber insert or the like. The skylight protective cover may produce an enhanced level of thermal insulation by trapping a layer of insulating air between the skylight protective cover. The skylight protective cover may reduce heat loss from an internal structure that would otherwise melt snow and ice on an exterior of the conventional skylight that reduces heat loss from the internal structure that would otherwise melt snow and ice on the exterior of the conventional skylight. The skylight protective cover is capable of being secured upon an upper and perimeter mounting flashing having a plurality of mounting holes, the upper and perimeter mounting flashing is disposed on the peripheral frames.

The enhanced thermal barrier may be formed by the skylight protective cover protects against the skylight that prevents condensation on the interior of the skylight thereby reducing interior water damage.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
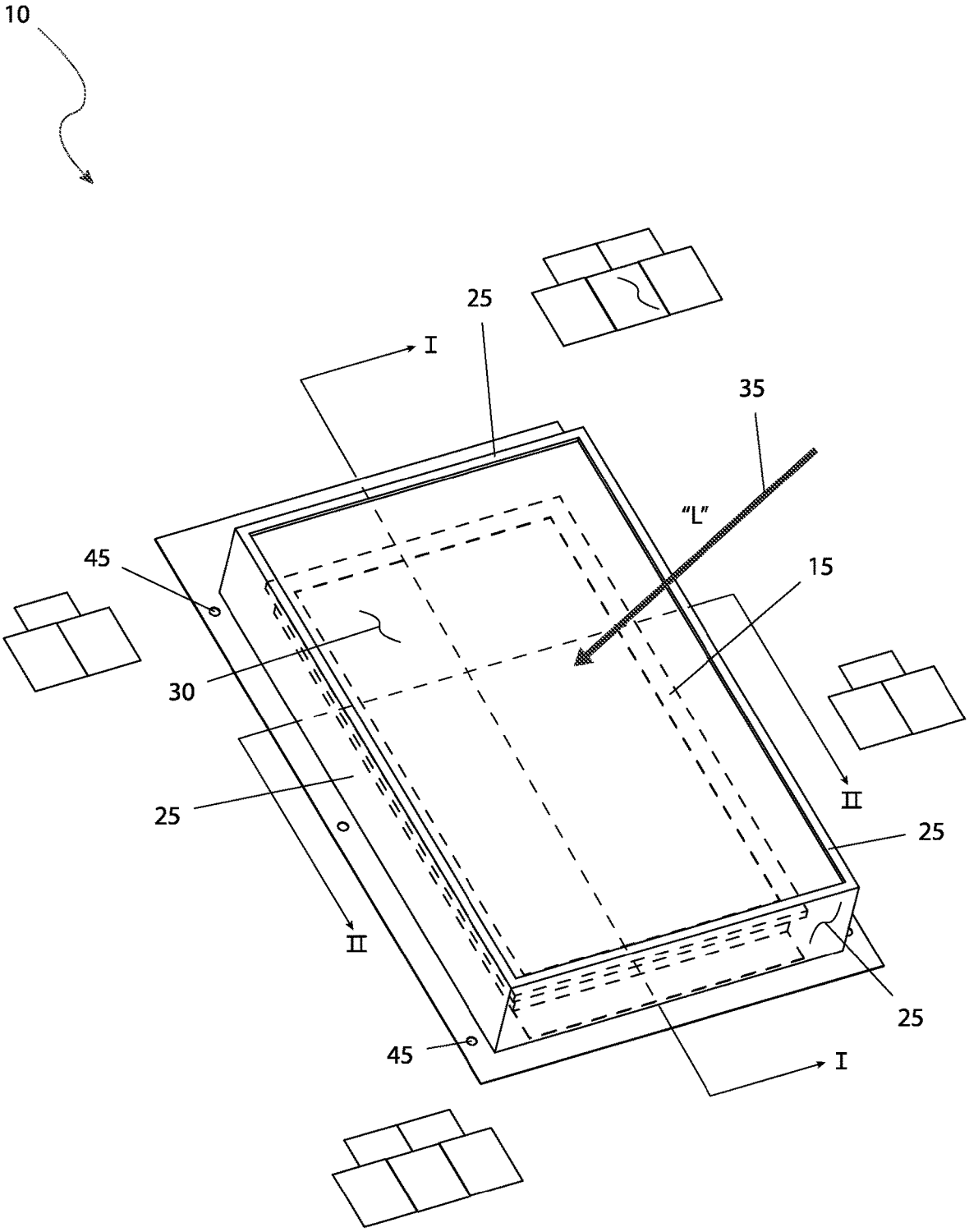
FIG. 1 is a perspective view of a protective cover for a skylight, shown in an installed state, according to the preferred embodiment of the present invention.

10 protective cover
15 skylight
20 roof surface
25 peripheral frame
30 vision surface
35 incoming light rays
40 upper flashing
45 mounting hole
50 water barrier area
55 structural member
60 exterior sheathing
65 interior surface
70 conventional skylight flashing
75 fastener
80 holding channel
85 sealing method
90 interstitial space

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a perspective view of a protective cover 10 for a skylight 15, shown in an installed state, according to the preferred embodiment of the present invention is disclosed. The protective cover (herein also described as the "cover") 10, provides a shroud around and above an existing skylight 15 in such a manner that it protects the existing skylight 15 from water, ice, snow, leaves, debris and other situations that can allow the existing skylight 15 or any installation components to leak into the structure. The cover 10 is installed over a conventional skylight 15 mounted on a roof surface 20, herein depicted as a fixed conventional skylight 15 mounting on an asphalt shingle style roof surface 20 without modification or alteration to the conventional skylight 15 or the roof surface 20. However, virtually all styles of conventional skylight 15 including but not limited to ventilating, fixed, and tubular, with a wide variety of shapes including but not limited to flat, arched, domed, and pyramid. Likewise, the roof surface 20 used with the cover 10 may include, but not be limited to metal roofing, slate shingles, rubber membrane, solar roofs, wood shakes, built-up roofs, and the like. Accordingly, the use of the cover 10 only with any particular style of conventional skylight 15 or roof surface 20, is not intended to be a limiting factor of the present invention.

The cover 10 includes at least four (4) peripheral frames 25 that border the cover 10. Each peripheral frame 25 is envisioned to be made from of metal, plastic, wood or composite material, and is located a discrete distance from the conventional skylight 15 on all sides. The top of the cover 10 is provided with a vision surface 30 envisioned to be made of a smooth transparent material such as glass or plastic allowing for the transmission of undistorted incoming light rays 35. An alternate construction may consist of the peripheral frame 25 and the vision surface 30 being one continuous section of plastic made in a blow molding process. Said configuration between the cover 10 and the existing conventional skylight 15 on all sides and the top thereby prevents water, snow, ice, debris and hazards from contacting the conventional skylight 15.

The cover 10 may be installed over a conventional skylight 15 during initial construction or may be installed at a later date over an existing conventional skylight 15. The cover 10 may be installed over a fully functional conventional skylight 15, or over a malfunctioning and leaking conventional skylight 15 to prevent leakage. The cover 10 provides an enhanced level of thermal insulation by trapping a layer of insulating air between the cover 10 and the conventional skylight 15. Said thermal insulation reduces heat loss from the internal structure that would otherwise melt snow and ice on the exterior of the conventional skylight 15. Accordingly, the additional insulation provides for any snow and ice trapped atop the cover 10 to remain in solid state. Additionally, the enhanced thermal barrier formed by the cover 10 against the conventional skylight 15 prevents the occurrence of condensation on the interior of the conventional skylight 15, thus reducing interior water damage. The smoother upper surface of the vision surface 30 allows snow and ice to slide off said vision surface 30 onto the roof surface 20 without melting thereby preventing the subsequent freezing of water and accumulation of ice on the roof surface 20 along with associated ice dams and trapped water that would otherwise infiltrate into the structure. The cover 10 provides physical protection for the conventional skylight 15 against damage from branches, hail, wind and other damaging objects and forces. Finally, the cover 10 is not readily visible when viewed from inside the structure thus preserving the beauty of exterior views from the structure.

Figure 2:
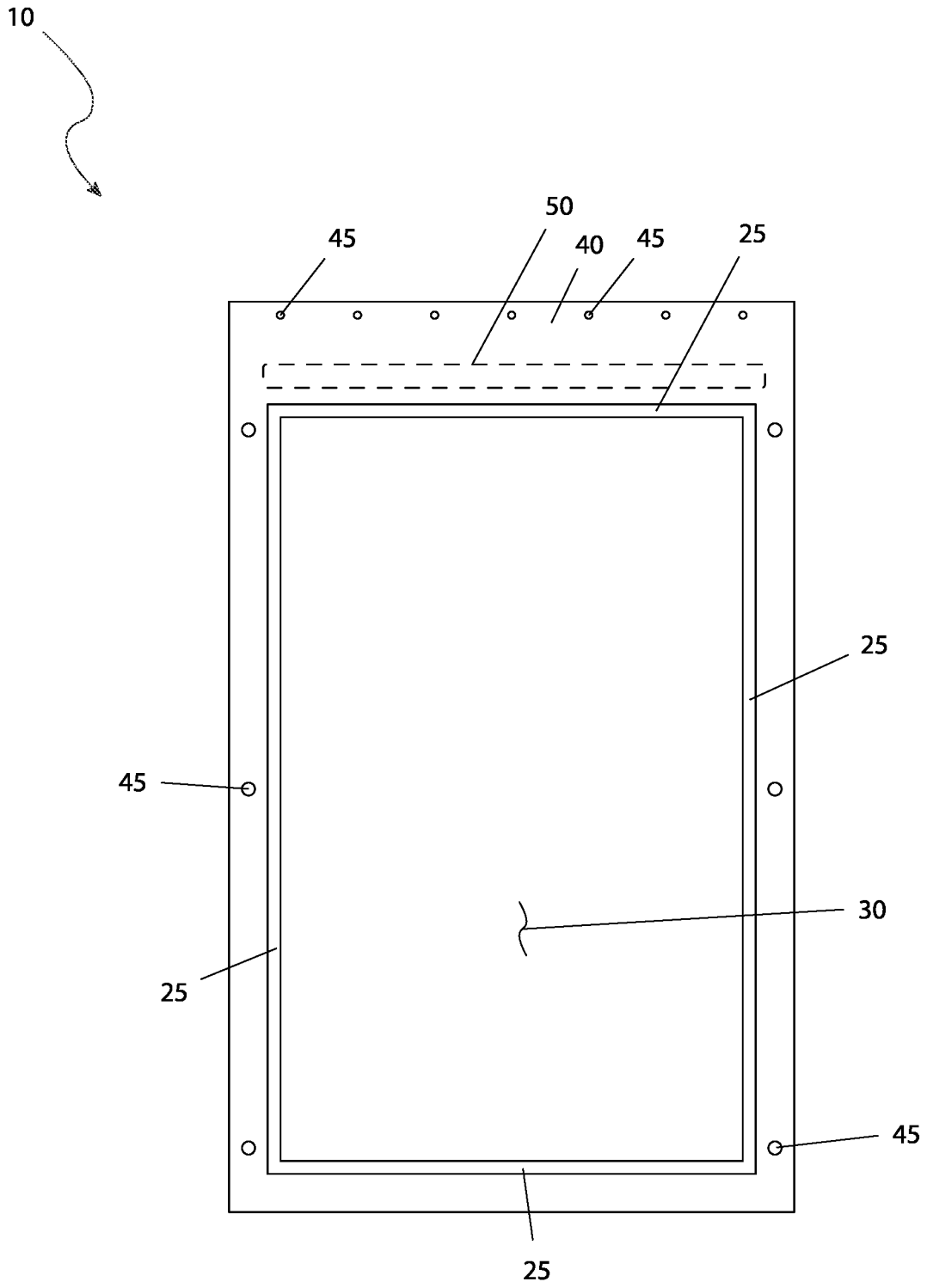
FIG. 2 is a top view of the protective cover, according to the preferred embodiment of the present invention.

Referring next to FIG. 2, a top view of the cover 10, according to the preferred embodiment of the present invention is depicted. The peripheral frame 25 forms a rectangle about the vision surface 30. Mounting holes 45 located at equidistant positions along the perimeter flashings 40 allow for attachment of the cover 10 to the roof surface 20 (as shown in FIG. 1). The upper and perimeter flashings 40 form a water barrier area 50 to prevent entrance of water under the cover 10 as might be expected with sloped roofs. It is envisioned that the upper and perimeter flashings 40 would be made of metal or plastic. The positioning of the mounting holes 45 on the perimeter flashings 40 enable ease and quickness of installation and demolition as necessary without having to engage with the roof.

Figure 3:
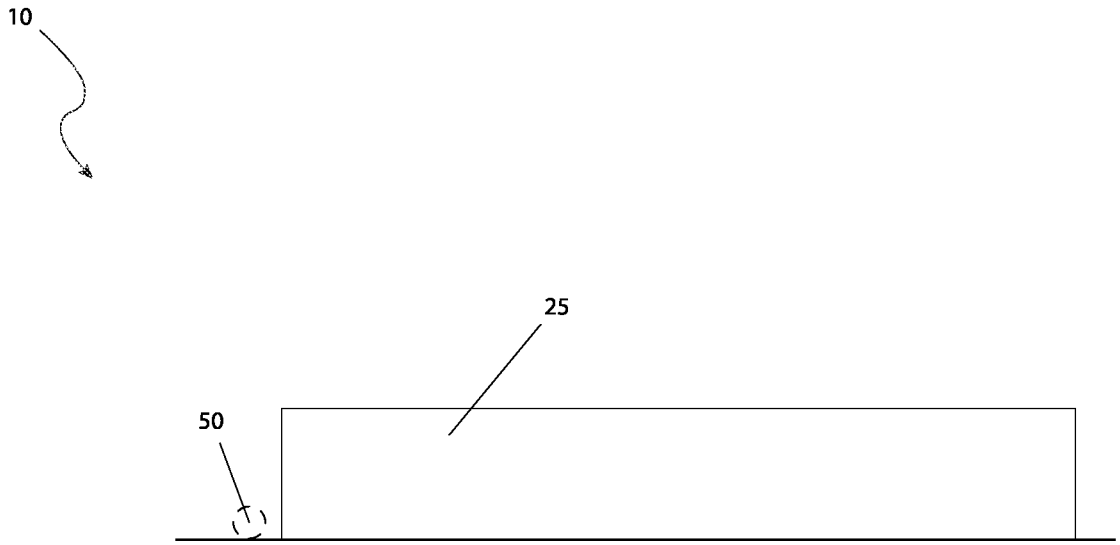
FIG. 3 is a side view of protective cover, according to the preferred embodiment of the present invention.

Referring now to FIG. 3, a side view of cover 10, according to the preferred embodiment of the present invention is shown. This view provides an alternate view of the peripheral frame 25 and the upper flashing 40 and is formation of the water barrier area 50. The overall form of the cover 10 lends itself to the Do-it-Yourself (DIY) market of installation by the final user. The size of the cover 10 may vary depending on the specific size of the conventional skylight 15 (as shown in FIG. 1) that the cover 10 is intended to cover. It is noted that a much larger cover 10 can still satisfactorily cover a smaller conventional skylight 15.

Figure 4:
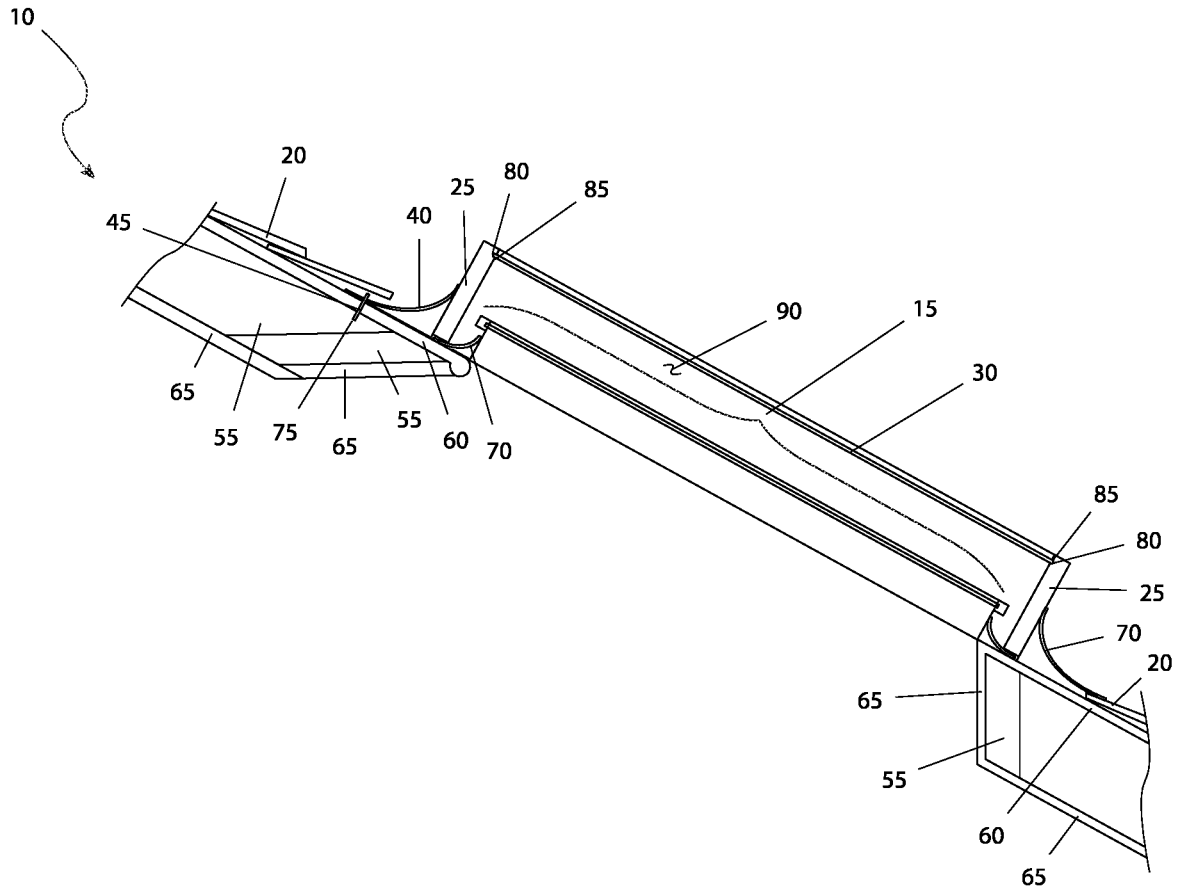
FIG. 4 is a sectional view of the protective cover, as seen along a Line I-I, as shown in FIG. 1, according to the preferred embodiment of the present invention.

Referring next to FIG. 4, a sectional view of the cover 10, as seen along a Line I-I, as shown in FIG. 1, according to the preferred embodiment of the present invention is disclosed. The conventional skylight 15 is installed to structural members 55 such as roof rafters, cross members, and the like. Various exterior sheathing 60 such as plywood or orientated strand board are installed on the top side of the structural members 55 while interior surfaces 65 such as drywall or paneling are installed on the interior side. A conventional skylight flashing 70, installed as part of the conventional skylight 15 integrates with roof surface 20 according to the conventional skylight 15 manufacturer's instructions. A similar section of conventional skylight flashing 70 is provided on the bottom of the conventional skylight 15 as well. The upper flashing 40 on the cover 10 is integrated into the roof surface 20 as shown. A fastener 75 such as a nail or screw is routed through the mounting holes 45 (as shown in FIG. 2) and into the exterior sheathing 60 and/or structural members 55 to hold the cover 10 in place. The vision surface 30 is routed into a holding channel 80 on the peripheral frame 25 with a sealing method 85 such as caulking, rubber insert, or the like. This view clearly depicts the interstitial space between the cover 10 and the conventional skylight 15, thus improving overall thermal barrier effectiveness as well as reducing condensation. In an exemplary embodiment, the lower edge of the vision 30 surface should be smooth and without any obstruction that would inhibit snow or ice from sliding off freely onto the roof surface 20 below. Any portion of the peripheral frame 25, particularly the lower edge, should not protrude above the vision surface 30.

Figure 5:
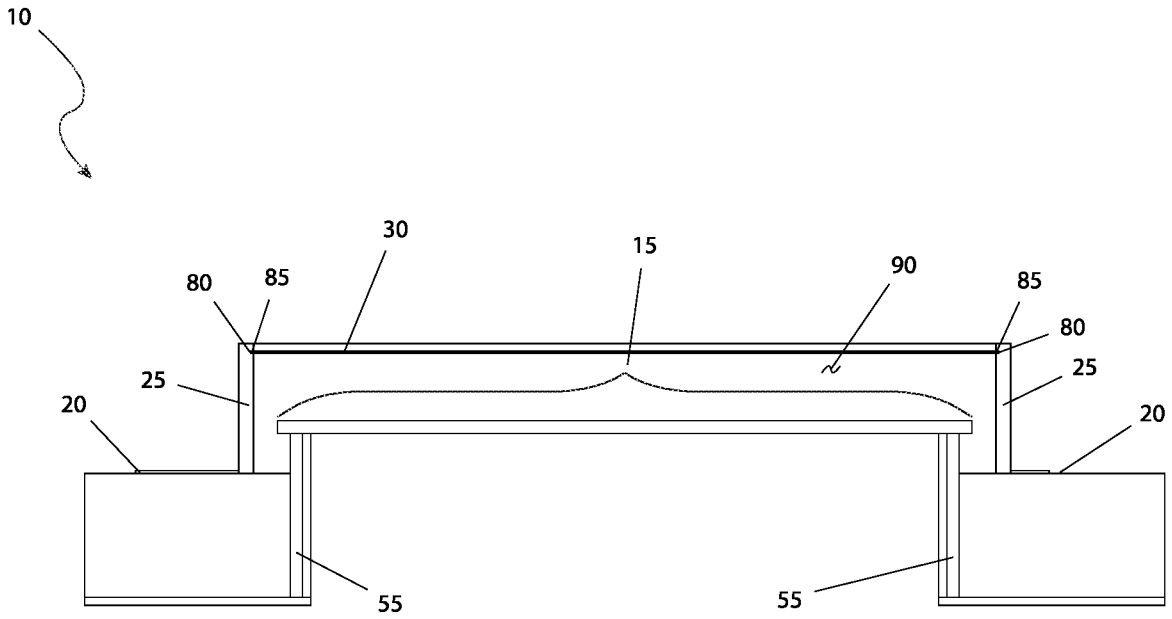
FIG. 5 is a sectional view of the protective cover, as seen along a Line II-II, as shown in FIG. 1, according to the preferred embodiment of the present invention.

Referring to FIG. 5, a sectional view of the cover 10, as seen along a Line II-II, as shown in FIG. 1, according to the preferred embodiment of the present invention is depicted. As with FIG. 4, the cover 10 provides a protective cover over the conventional skylight 15. The conventional skylight 15 is installed on the structural members 55 in a conventional manner. As aforementioned described, the conventional skylight 15 may or may not be fully functional or weatherproof. The peripheral frame 25 of the cover 10 rests upon the roof surface 20. The vision surface 30 is embedded in the holding channel 80 and the sealing method 85 of the peripheral frame 25. This configuration produces a protective cover as well as the interstitial space 90 to prohibit water and weather elements from contacting the conventional skylight 15, thus eliminating leaks and damage to the structural members 55. It is envisioned that the cover 10 may remain in place to serve as a temporary repair until a permanent repair of the conventional skylight 15 may be made, or as a permanent supplemental addition which provides enhanced physical and thermal attributes due to the interstitial space 90.

2. Operation of the Preferred Embodiment

The preferred embodiment of the present invention can be utilized by the common user in a simple and effortless manner with little or no training. It is envisioned that the cover 10 would be constructed in general accordance with FIG. 1 through FIG. 5. The user would procure the cover 10 from conventional procurement channels such as hardware stores, home improvement stores, mechanical supply houses, wholesale window suppliers, mail order and internet supply houses and the like. Special attention would be paid to the overall size of the cover 10 such that it completely covers the conventional skylight 15 with adequate clearance as depicted in FIGS. 4 and 5.

After procurement and prior to utilization, the cover 10 would be installed in the following manner: the cover 10 would be set over the conventional skylight 15, in either a retrofit or new installation; the upper flashing 40 would be integrated to the roof surface 20 depending on its type and configuration and the cover 10 would be secured via multiple fastener 75 through the mounting holes 45 in the perimeter flashing 40 to the roof surface 20, the exterior sheathing 60, and/or the structural members 55. At this point in time, the cover 10 is ready for utilization.

During utilization of the cover 10, the following procedure would be initiated: utilization of cover 10 is similar in nature to utilization and enjoyment of a conventional skylight 15 alone. Vision through the conventional skylight 15 and the vision surface 30 of the cover 10 is obtained in a conventional manner. Enhancements when compared to a conventional skylight 15 alone, include but are not limited to reduction of leaks from the skylight frame, flashing, seals, and pane areas, correction of improper installation, aged caulking, aged glazing, aged weatherstripping, contaminations, skylight installation, missing ice shields, reduced accumulation of leaves, branches or debris that accumulates and inhibits the free drainage of water from around the skylight. Reduction of condensation, improved thermal performance, reduced thermal loss, protection from physical damage such as hail, ice, debris, branches, balls, toys, uses in re-roofing projects where the conventional skylight 15 remains too low for proper flashing, and other installations where conventional replacement of the conventional skylight 15 is not possible.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A skylight protective cover, comprising:

a plurality of peripheral frames making a border;

a vision surface disposed on the peripheral frames;

a conventional skylight flashing adapted to be installed as part of a skylight that integrates with a roof surface and is adapted to be disposed on a bottom of the skylight;

a fastener routed through a plurality of mounting holes and into the roof surface and/or the structural members to hold the skylight protective cover in place; and a holding channel receiving the vision surface disposed on the peripheral frames, the vision surface is secured to the peripheral frames with a sealing method;

wherein the skylight protective cover is capable of being secured upon an upper flashing and a perimeter mounting flashing having the mounting holes, the upper flashing and the perimeter mounting flashing disposed on the peripheral frames;

wherein the skylight protective cover is made of a smooth transparent material allowing for transmission a plurality of undistorted incoming light rays;

wherein the fastener is a nail or a screw; and wherein the peripheral frames and the upper flashing and the perimeter mounting flashing form a water barrier area.

2. The skylight protective cover, according to claim 1, wherein each of the peripheral frames are made from of a material selected from the group consisting of a metal material, a plastic material, a wood material, or a composite material.

3. The skylight protective cover, according to claim 1, wherein the smooth transparent material is made of glass.

4. The skylight protective cover, according to claim 1, wherein the smooth transparent material is made of plastic.

5. The skylight protective cover, according to claim 1, wherein the peripheral frames and the vision surface are one continuous section of blow molded, injection molded, vacuum formed, or another manner of molded plastic.

6. The skylight protective cover, according to claim 1, wherein the vision surface includes a smooth upper surface that allows a plurality of debris to slide off the vision surface onto the roof surface without melting.

7. The skylight protective cover, according to claim 6, wherein the smooth upper surface prevents a subsequent freezing of water and accumulation of snow and or ice on the roof surface that would otherwise infiltrate into a structure.

8. The skylight protective cover, according to claim 1, wherein the sealing method is caulking.

9. The skylight protective cover, according to claim 1, wherein the sealing method is a rubber insert.

* * * * *